United States Patent [19]

Olivares

[11] Patent Number: 4,685,416

[45] Date of Patent: Aug. 11, 1987

[54] APPARATUS FOR CONTINUOUSLY APPLYING BITUMEN TO CABLES

[75] Inventor: Sergio Olivares, Vittuone, Italy

[73] Assignee: Societa' Cavi Pirelli S.p.A., Milan, Italy

[21] Appl. No.: 858,596

[22] Filed: May 1, 1986

[30] Foreign Application Priority Data

May 31, 1985 [IT] Italy ..... 20994 A/85

[51] Int. Cl.[4] ..... B05C 11/02; B05C 5/00

[52] U.S. Cl. ..... 118/125; 118/304; 118/420; 118/429; 118/DIG. 11

[58] Field of Search ..... 118/DIG. 11, 420, 429, 118/405, 125, 304, DIG. 19

[56] References Cited

U.S. PATENT DOCUMENTS

| | | | |
|---|---|---|---|
| 1,909,882 | 5/1933 | Morain | 118/DIG. 11 |
| 2,014,378 | 9/1935 | Gardener et al. | 118/DIG. 11 |
| 2,034,794 | 3/1936 | Brunberg | 118/420 X |
| 2,188,001 | 1/1940 | Duaei et al. | 118/DIG. 11 |
| 2,255,436 | 9/1941 | Olson | 118/405 X |

*Primary Examiner*—John P. McIntosh
*Attorney, Agent, or Firm*—Brooks Haidt Haffner & Delahunty

[57] ABSTRACT

Coating apparatus for coating a cable with bitumen which is self-contained except for apparatus for supplying a heated fluid to the coating apparatus. The coating apparatus includes a tank for receiving bitumen and has pipes therein to which heated fluid at a temperature sufficient to melt solid bitumen is supplied by external fluid heating apparatus and in which the heated fluid circulates. The cable passes through the apparatus in a trough to which liquid bitumen is supplied by a rotating cylinder partially immersed in the liquid bitumen and connected, for liquid bitumen delivery, to the trough by a pivotable chute. A tiltable cradle receives solid bitumen and dumps it into the tank where it is melted. A wiper in the form of a tensioned, elongate elastic body is wrapped by at least one turn around the cable where it leaves the coating apparatus and an elastic tab engages the cable adjacent the cable inlet to divert liquid bitumen which may flow toward the inlet.

9 Claims, 5 Drawing Figures

APPARATUS FOR CONTINUOUSLY APPLYING BITUMEN TO CABLES

The present invention relates to an equipment for externally covering an electric cable, or cables of other types, with a layer of a material which becomes liquid when heated, such as bitumen, asphalt or tar. Such operation is commonly known as "tarring".

Cables used either for transmitting power or information, are often covered with one or more layers of bitumen in order to protect the armors, the insulation and other components which are likely to be altered. This protecting layer is applied both to underground cables and to submarine cables and is formed by suitable substances, such as natural tars, oxidized bitumens, bituminous mixtures and other bitumen derivatives or products. Such substances resist sea water for a long time and are used as protection for the cable components which are most subject to alterations due to the ambient, such as wires, steel strips, ropes, plies, paper, etc.

The bituminizing operations are carried out in stationary bituminizing machines which are installed on the various cable production lines and which have dimensions and characteristics suitable for the various production needs.

Because the application of the coating should be uninterrupted and because of the required amounts of bitumen, in particular for long lengths of cables, the machines of this kind receive the hot bitumen through very extensive distribution systems from storage plants where it is maintained in the liquid state. The storage plants are fed with liquid bitumen transported by tankers since the thermal capability of the plants is designed only for maintaining the bitumen at the temperature of use.

Some bituminizing machines are associated with feeding plants provided with bitumen melting devices and are able to stock limited amounts of liquid bitumen which is then conveyed to the bituminizing machines. Also, in this case, the bituminizing machines themselves receive the bitumen in the liquid form from the feeding plants.

Such prior art machines have a number of drawbacks which will be explained hereinafter.

The storage plants must work in an almost continuous manner because the interruption of the application of the bitumen causes the solidification of the bitumen in the plant with severe consequences which can require the partial rebuilding of the plant itself. This causes very high operating costs for maintaining the bitumen hot, especially when the cable production is discontinuous.

Another drawback derives from the chemical and/or physical alterations of the bitumen contained in the plants which, after circulating in the plant for a long time, tends to have a softening temperature (or dropping point) different from the softening temperature of freshly applied bitumen. The problem becomes still more serious when the plant must deliver different types of bitumen.

Also, the "cracking" phenomena, which unavoidably take place in the plant, produce foulings inside the tubes, tanks, pumps and these substances hinder the bitumen flow to the point that the plant becomes clogged.

Finally, the dependence of the known bitumen applying machines on the bitumen feeding plants makes it practically impossible to transfer such machines to other points of the cable production line where they could be required or used.

One object of the present invention is that of providing apparatus for continuously applying bitumen to an electric cable which is self-sufficient and can be fed with cold bitumen so that a centralized feeding of liquid bitumen is not required.

Another object of the present invention is that of providing a machine for applying bitumen to an electric cable which is improved with respect to the melting of the bitumen and its application to the cable.

In accordance with the invention, the apparatus for continuously applying a layer of bitumen to cables, comprises a tank containing the bitumen in the liquid state, a liquid bitumen carrying channel along which the cable passes and means for continuously withdrawing the liquid bitumen from the tank and conveying it into said channel. Said apparatus has means for melting the bitumen fed in a solid state to the apparatus, which means comprise a fluid circulating in pipes within the tank in thermal exchange relationship with the bitumen which is in the tank, means for heating said fluid and means for circulating the fluid through the pipes.

Other objects and advantages of the present invention will be apparent from the following detailed description of the presently preferred embodiments thereof, which description should be considered in conjunction with the accompanying drawings in which.

Figure 1:
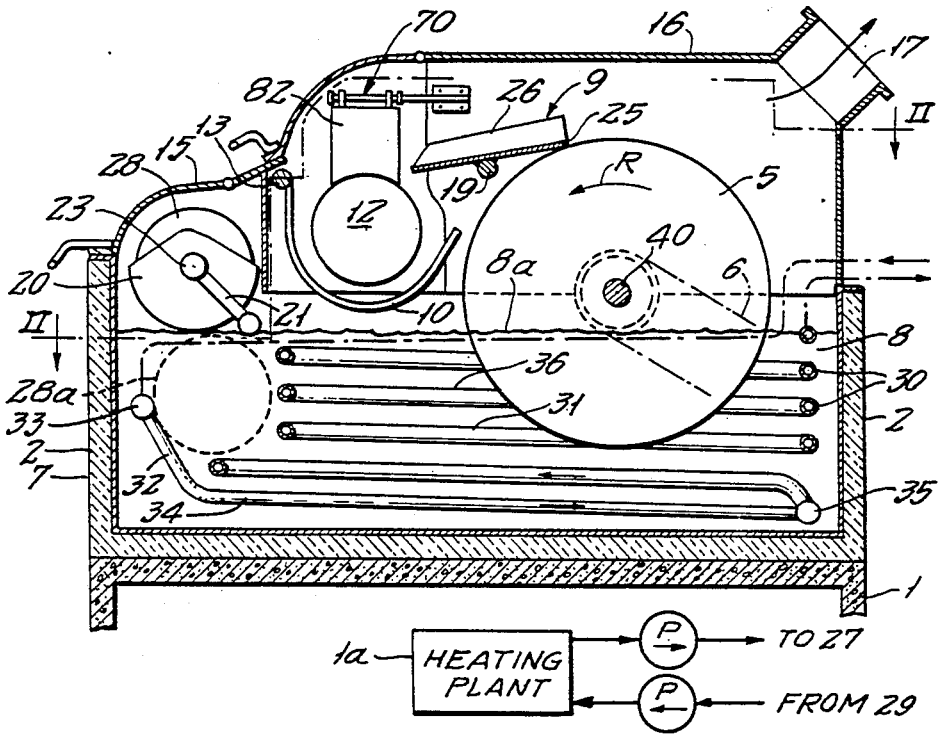
FIG. 1 is a sectional side view of the equipment according to the invention.
Figure 2:
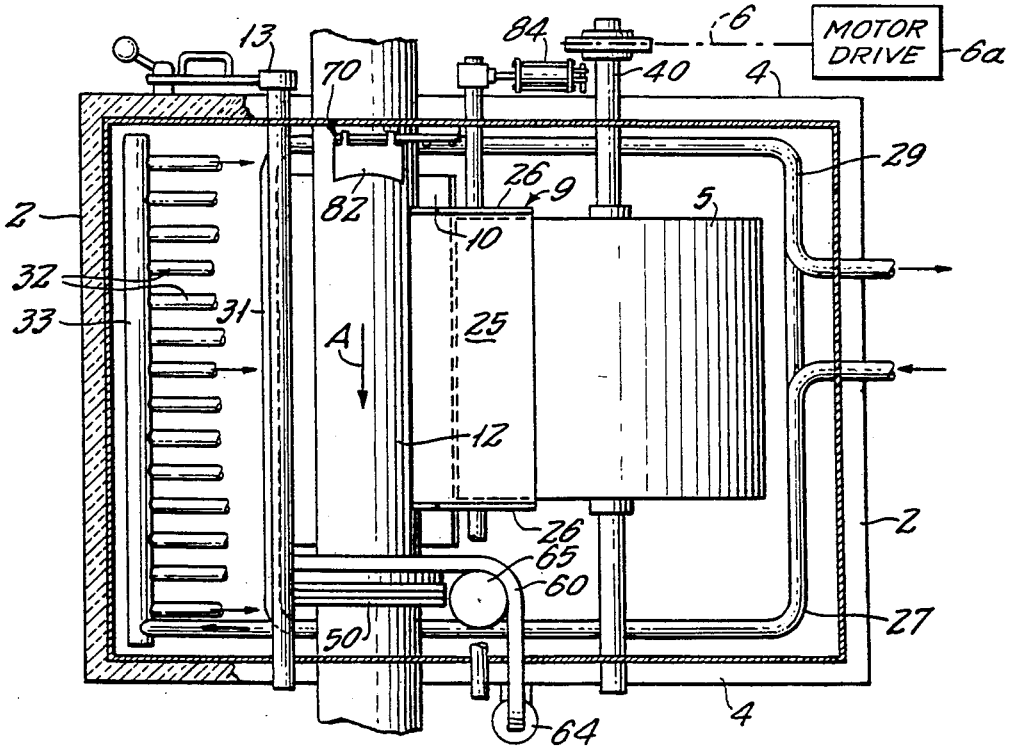
FIG. 2 is a section along line II—II of FIG. 1.

The equipment shown schematically in the FIGS. 1 and 2 comprises a basement or chamber 1 on which there is a tank 7 which has lateral walls 2 and 4 and which is closed at the upper part by a covering 16. The covering 16 is provided with a gas outlet opening 17 and a feeding cover 15 which will be later described in more detail.

In the lower part of the tank 7, there is disposed a pipe system 30–36 in which a heating fluid circulates, such as, for example, a heat radiating oil heated by a heating plant 1*a* in the basement 1 and circulated by pumps. The heating fluid can be heated by resistors or by other known means and is supplied to a transverse conduit 27 connected to a longitudinal manifold 33. Here and hereinafter, the terms "longitudinal" and "transverse" are referred to the direction of advance of the cable which is indicated by the arrow A in FIG. 2.

A plurality of inclined pipes or conduits 32 extend from the manifold 33, the elevation of which is intermediate the elevations of the other upper and lower pipes. The conduits 32 extend near the bottom of the tank 7 and continue (see 34) to a second longitudinal conduit 35. A coil of pipe extends, at one end, from the conduit 35 and progressively ascends, at 30, 31, 36, along all the four lateral walls (2 and 4) of the tank 7 and at the other end, extends to the outside of the tank 7 by way of the conduit 29. For the sake of simplicity, in illustrastion, the conduits 34 are not shown in FIG. 2. The whole system of the pipes is submerged in the liquid bitumen 8, the level 8*a* of which can vary within certain limits depending on the dimensions of the cable 12 to be coated.

A cylinder 5, which may be hollow, is mounted on a rotatable shaft 40 between the lateral walls 4 of the tank 7 and is rotated at constant speed in the direction of the arrow R by a conventional driving means represented by the chain or belt which is connected to a motor drive 6*a*. The cylinder 5 extends in the direction of the cable 12 for a considerable length, at least for more than one half of the length of the tank 7, and is partially immersed in the bath of bitumen so as to continuously raise a layer of liquid bitumen adhering to its surface. In proximity of the highest point of the wheel 5, there is mounted a chute 9 including a blade 25, which extends for the axial length of the surface of the cylinder 5, and two walls 26. The chute 9 is mounted on a pivotable bar 19 in order to vary the quantity of bitumen withdrawn from the wheel 15 as will be described hereinafter.

The fluid bitumen received by the chute 9 pours into an underlying trough 10 providing a channel within which the cable 12 to be coated is advanced.

The trough 10 is pivotable with respect to the cover 16 at the point 13 so that its position can be changed to adjust for the different diameters of the cables to be coated. The apparatus includes a device 70 for directing the bitumen away from the inlet of the trough 10 and a wiper device 50 at the outlet end of the trough 10 which will be described in more detail hereinafter.

The apparatus according to the invention is fed with bitumen in the solid state, in the form of elongated charges or slugs, preferably, cylindrical charges, which are introduced into the equipment manually or automatically. The loading device comprises a cradle 20 tiltable around its longitudinal axis 23 and protected by a cover 15 which may be raised and an actuator 21.

In the embodiment which provides for the manual feeding, the actuator 21 is constituted by a lever manually operable by the operator so as to tip the cradle 20 and to drop the charge 28 in it into the tank below. In the case of automatic feeding, the actuator 21 can be an actuating belt intermittently advanced in synchronism with a conveyor for delivering the charge 28.

The charge 28 dropped into the tank tends to sink, owing to its greater specific gravity with respect to that of the liquid bitumen, and rests against the hot pipes 31 and 32 which define a melting zone and which commence division of the charge into smaller pieces by a localized melting. A charge 28*a*, represented with a dashed line in FIG. 1, is shown in FIG. 1 in position to be cut through by the pipes 31 and 32 and, in particular, by the pipes 32 in which the heating fluid is at the highest temperature. The charge 28*a* can leave the melting space defined between the pipes 31 and 32 only after being divided into much smaller pieces which will be then rapidly melted in the bath surrounded by the coil of pipes. The dimensions of the melting zone and/or those of the charges can be such as to permit the presence of three or more piled charges in the melting zone. The action of the cylinder 5, extending for most of the tank, contributes to the rapid melting of the bitumen by stirring the whole melted mass.

Another contribution to the quick melting of the charges comes from the structure of the loading device. In fact, the successive charges will be dropped onto the charge or charges already in contact with the pipes thereby exerting a thrust equal to its own weight on the latter, and since the weight of the charges is in the order of several kilograms, a quick division of the bitumen charges is promoted. A too rapid loading will be detected by a resistance to rotation of the cradle 20 which will be impeded by the previous charge which has not yet sufficiently sunk. In the manual feeding, the operator will be able to resume the loading when the previous charge has sufficiently sunk. In the automatic feeding, a conventional overload detector can accomplish the same function.

Figure 3:
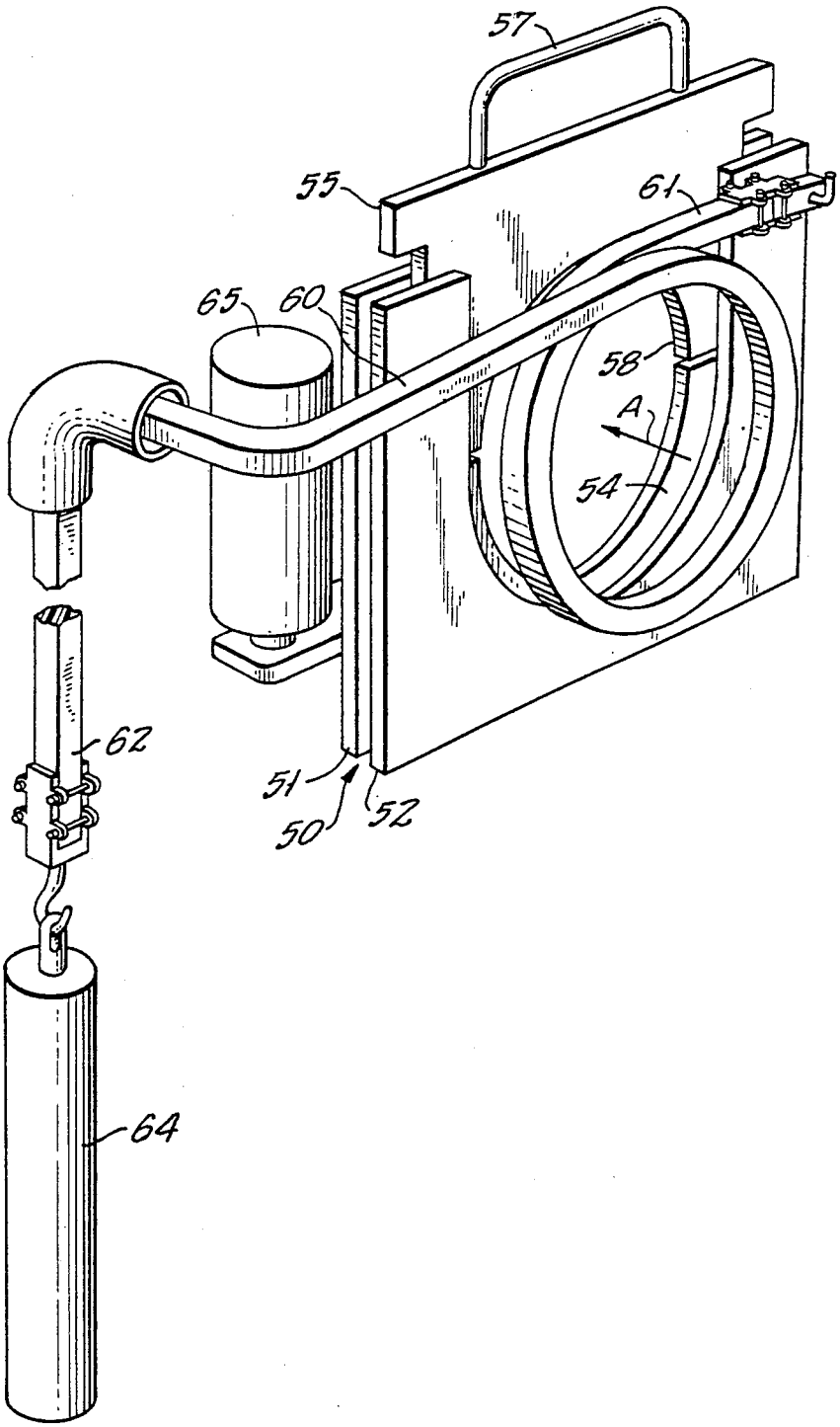
FIG. 3 is an enlarged perspective view of the coating wiper shown in FIG. 2.

As best seen in FIG. 2, the cable 12 passes through the apparatus above the bottom of the trough 10 and leaves the apparatus covered with a layer of solidifying bitumen. At the outlet end, there is provided a wiper device 50 for eliminating the excess of bitumen, said device 50 being shown in detail in FIG. 3 where, for sake of simplicity in illustration, the cable has not been represented. Said wiper device 50 comprises a support formed by two guides 51, 52 within which two plates 54, 55 are mounted, one over the other. Each one of the said plates 54 and 55 has a half-circle recess which, together, form a circular opening 58 for the passage of the cable 12, the opening 58 having a greater diameter than the cable 12. The pairs of plates 54 and 55 can be easily replaced to adjust the device 50 to cables of different diameters to be coated, and the upper plate 55 is provided with a lifting handle 57.

Immediately behind the plates 54 and 55 (i.e. inside the machine), the cable 12 is wrapped by an elongated elastic body 60 having one end 61 anchored to the guide 52 and the other end 62 connected to adjustable tensioning means, such as, a weight 64. The elongated element 60 has at least one complete turn around the cable 12 and passes over an idler roll 65. Said elongated element 60 is subjected to a longitudinal traction due to the weight 64 so as to adhere to the coated cable and to wipe any excess of bitumen. The advancing movement of the cable 16 causes the body 60 to bear against the walls of the plates 54 and 55 so that any excess of bitumen is returned into the inside of the tank 7.

Preferably, the elongated body 60 is formed by an elastomeric or plastomeric article having a rectangular section. Silicone rubber has been found to be particularly suitable for this purpose since the bitumen does not stick to the silicone rubber, and the body 60 can be re-used after removing accumulations of bitumen.

Figure 5:
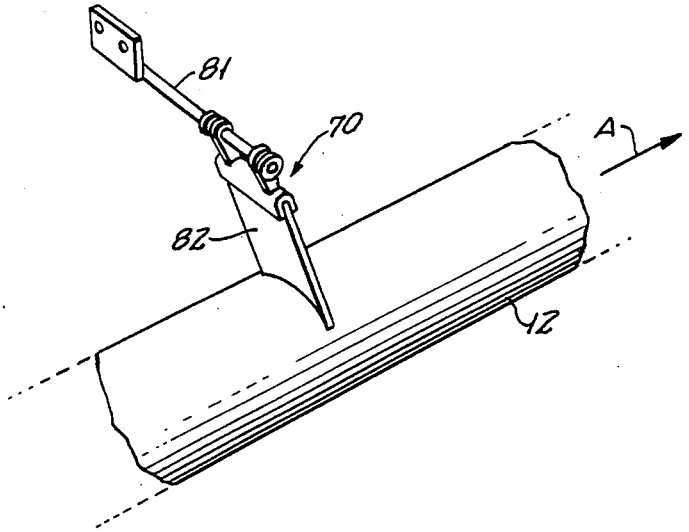
FIG. 5 is an enlarged perspective view of the device for preventing the bitumen from flowing toward the cable entrance in the event that the advance of the cable should be stopped.

At the cable inlet end of the apparatus, there is provided a device 70 for obstructing any outward flow of bitumen. Said device 70 is constituted by a support 81 (FIG. 5) secured to the cover 16 and carrying a tab 82 of plastic material which is shaped, at its lower part, according to an arc. The tab 82 rests on the cable 12 with a certain degree of friction. During the advancing movement of the cable 12 in the direction indicated by the arrow A, the bitumen that drops on the cable is dragged toward the outlet by the cable and does not tend to flow in the reverse direction from the apparatus. In case the cable should stop advancing for any reason, the tab 82 prevents the bitumen from flowing outside of the apparatus.

Figure 4:
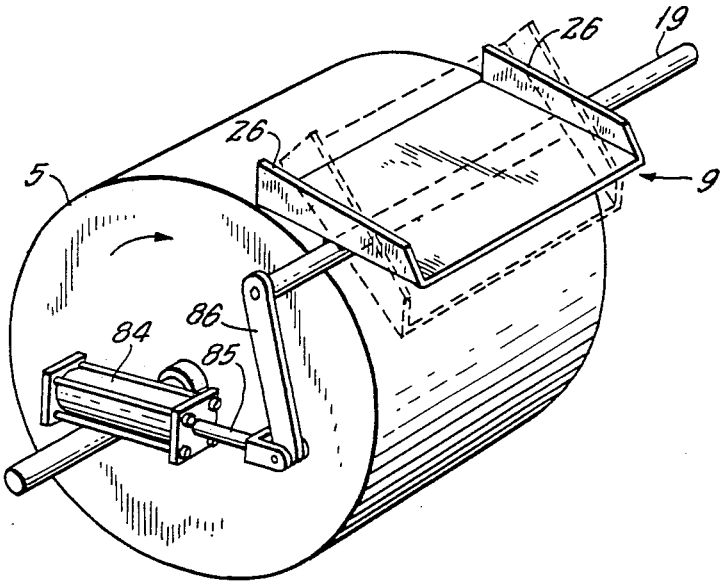
FIG. 4 is an enlarged perspective view of the device for adjusting the amount of bitumen withdrawn from the tank which is shown in FIGS. 1 and 2.

FIG. 4 schematically shows the device for adjusting the position of the chute 9 which permits adjustment of the amount of bitumen supplied by the cylinder 5. Said device comprises a cylinder and piston assembly 84 and 85 having the end of the piston 85 joined by a swivelled clevis to a lever 86, the other end of the lever 86 being connected to the pivotable rod 19 on the chute 9. It is thus possible to change the amount of bitumen conveyed to the trough 10 as required by the characteristics and sizes of the cables. Moreover, the cylinder and piston assembly is connected to the system for advancing the cable 12 so that in case the advance of the cable 12 is stopped, the cylinder and piston assembly immediately rotates the chute 9 to a position where the bitumen is not collected, such position being indicated in dotted lines in FIG. 4. In case the cable advance should be stopped, the supply of heat by the bitumen, which can damage the cable itself,is discontinued.

The apparatus according to the present invention achieves the stated objects. In fact, it is completely independent of the plants for storing or melting the bitumen and can be installed wherever it is necessary in the cable production line. Because of its self-sufficiency, the apparatus can be moved from one station to the other of the production lines and adjusted to the requirements of the various cables. It will be apparent that the tank 7 with the apparatus therein or thereon can be moved independently of the heating plant 1*a*, and it is merely necessary to add piping for conveying the heated oil from the heating plant la to the pipes 27 and 29.

In addition, the apparatus is very economical, when compared with the centralized heating or storage plants, since it is heated only when necessary and even if it is kept continuously in operation, the energy consumption is only that necessary to maintain the bitumen within the tank 7 in a liquid state whereas the charges of bitumen are advantageously maintained in the solid state.

The use of an intermediate heating fluid reaching any portion of the interior of the tank 7, such as the heated oil, 20. eliminates the drawback of the overheating which occurs in the known melting plants where resistors are submerged in the bath and are directly in contact with the bitumen. The risks of bitumen cracking and fouling, which limit the lifetime of the apparatus, are thus avoided.

Also, by means of the apparatus according to the invention, the characteristics of the applied bitumen can be controlled with great accuracy since it does not re-circulate for a long time and thereby become altered in an unknown or undesired manner. Also, all the problems connected with the use of bitumens with different characteristics are solved.

The feeding system described permits a quick melting of the charges of solid bitumen which immediately encounter the pipes at higher temperature and are pushed against them by the weight of the successive charges.

Finally, the wiper and protection devices described allow for a regular and well distributed coating of bitumen without the risk of damaging the cable in case the advance thereof is stopped and without causing a reverse flow of the bitumen from the apparatus.

Although preferred embodiments of the present invention have been described and illustrated, it will be apparent to those skilled in the art that various modifications may be made without departing from the principles of the invention.

The embodiments of the invention in which an exclusive property or privilege is claimed are defined as follows:

1. Apparatus for continuously coating a cable with a heated liquid bitumen, said apparatus comprising a tank, a trough disposed above the level to which the tank is to be filled with said liquid and for receiving a cable as it is advanced through said apparatus, means for continuously withdrawing said heated liquid from the tank and conveying it into said trough, heating mcans for heating said liquid bitumen and being adapted to operate at a temperature which will convert solid bitumen supplied to the tank into liquid bitumen, said heating means comprising heated fluid circulating pipes within said tank and disposed in positions in which they contact said liquid bitumen which is in said tank, a tiltable cradle disposed above the level to which the tank is to be filled with said liquid bitumen for receiving charges of solid bitumen and delivering said charges to said tank with tilting of said cradle, portions of said pipes being disposed in the path of delivery of said charges by said cradle and below said cradle to provide a melting zone for melting said charges and being spaced from each other for subdividing any said charges bearing thereagainst, each portion of said pipes being connected to a manifold and extending downwardly from said manifold toward the bottom of said tank and said manifold being connected to an inlet for said heated fluid so that the heated fluid in said manifold and said portions of said pipes will have a temperature which is higher than the temperature of the heated fluid in the remainder of said pipes.

2. Apparatus for continuously coating a cable with a heated liquid, said apparatus comprising a tank, a trough disposed above the level to which the tank is to be filled with said liquid and for receiving a cable as it is advanced through said apparatus, means for continuously withdrawing said heated liquid from the tank and conveying it into said trough, heating means for heating said liquid, said heating means comprising heated fluid circulating pipes within said tank and disposed in positions in which they contact said liquid which is in said tank, further heating means external to said tank for heating said fluid, said further heating means being connected to said heated fluid circulating pipes for supplying said heated fluid to said pipes, and circulating means connected to said pipes for circulating said heated fluid through said pipes, and said apparatus having a cable inlet adjacent one end of said trough and a cable outlet at the opposite end of said trough and comprising wiping means at said cable outlet for surrounding said cable and engaging the coating of heated liquid on said cable for removing surplus coating material, said wiping means comprising a plate having an opening therethrough larger than the exterior size of the cable to be coated to permit the passage of a cable therethrough, an elastic elongated body adjacent said plate and of a length sufficient to be wrapped in at least one turn around said cable and means engaging an end of said body for applying lengthwise tension thereto.

3. Apparatus as set forth in claim 2 wherein said elastic elongated body is made of a material selected from elastomeric and plastomeric materials.

4. Apparatus as set forth in claim 3 wherein said material is silicone rubber.

5. Apparatus as set forth in claim 3 wherein said body is rectangular in cross-section.

6. Apparatus for continuously coating a cable with a heated liquid, said apparatus comprising a tank, a trough disposed above the level to which the tank is to be filled with said liquid and for receiving a cable as it is advanced through said apparatus, means for continuously withdrawing said heated liquid from the tank and conveying it into said trough, said means for continuously withdrawing said heated liquid and conveying it to said trough comprises a rotatable cylinder disposed to have a portion of its periphery immersed in said heated liquid so that heated liquid contacts and adheres to said portion of said periphery and is lifted above the upper level of said heated liquid with rotation of said cylinder and a chute extending between another portion of said cylinder and said trough for delivering heated liquid from said cylinder to said trough, and heating means for heating said liquid, said heating neans comprising heated fluid circulating pipes within said tank and disposed in positions in which they contact said liquid which is in said tank.

7. Apparatus as set forth in claim 6 wherein said trough has a length in the direction of advance of a cable being coated of at least one-half the dimension of said tank in said direction, wherein the axis of said cylinder extends in said direction and said cylinder has an axial length of at least one-half said dimension of said tank and wherein the width of said chute extends in said direction and said chute has a width of at least one-half said dimension of said tank.

8. Apparatus as set forth in claim 6 wherein the length of said chute extends from said cylinder to said trough and wherein said chute is pivotable around an axis transverse to the length thereof for adjusting the amount of heated liquid delivered to said trough from said cylinder.

9. Apparatus as set forth in claim 8 further comprising cylinder and piston means connected to said chute for pivoting the latter.

* * * * *

UNITED STATES PATENT AND TRADEMARK OFFICE

CERTIFICATE OF CORRECTION

PATENT NO. : 4,685,416

DATED : August 11, 1987

INVENTOR(S) : Olivares

It is certified that error appears in the above-identified patent and that said Letters Patent is hereby corrected as shown below:

Col. 5, line 34, cancel "20"
Col. 6, line 3, "mcans" should read --means--;
Col. 7, line 9, "neans" should read --means--.

Signed and Sealed this

Twelfth Day of January, 1988

*Attest:*

DONALD J. QUIGG

*Attesting Officer*

*Commissioner of Patents and Trademarks*